US005900844A

United States Patent [19]

Hill

[11] Patent Number: 5,900,844

[45] Date of Patent: May 4, 1999

[54] WIDE BANDWIDTH ANTENNA ARRAYS

[75] Inventor: David Roy Hill, Wootton Bridge, United Kingdom

[73] Assignee: British Aerospace Defence Systems, Ltd., Farnborough, United Kingdom

[21] Appl. No.: 09/095,508

[22] Filed: Jun. 11, 1998

[30] Foreign Application Priority Data

Nov. 6, 1997 [GB] United Kingdom ..... 9711972

[51] Int. Cl.[6] ..... H01Q 9/16

[52] U.S. Cl. ..... 343/806; 343/803

[58] Field of Search ..... 343/793, 796, 343/797, 798, 800, 803, 804, 805, 806, 809, 810, 811; H01Q 9/16

[56] References Cited

U.S. PATENT DOCUMENTS 2,290,800 7/1942 Brown ..... 343/806
2,485,138 10/1949 Carter ..... 343/803
4,031,536 6/1977 Alford ..... 343/806
4,054,877 10/1977 Bogner et al. ..... 343/806

*Primary Examiner*—Don Wong
*Assistant Examiner*—Tho Phan
*Attorney, Agent, or Firm*—Evenson, McKeown Edwards & Lenahan P.L.L.C.

[57] ABSTRACT

A skewed Log Periodic Dipole Array (LPDA) used as the element in a linear or planar array, serves to remove the element spacing restriction and hence eliminates the grating lobe problem. The skewed form of the device has all dipoles greater in length than the shortest one, i.e. the highest frequency one, skewed such that they are "Z" shaped. When the angle between the end and center segments of the Z dipole is 90 degrees, the skewed LPDA has a constant width equal to the length of the highest frequency dipole.

20 Claims, 5 Drawing Sheets

WIDE BANDWIDTH ANTENNA ARRAYS

BACKGROUND OF THE INVENTION

This invention relates to the radiating elements used in radio frequency antenna arrays such as are found, for example, in certain radar equipment and more especially it relates to very wide frequency bandwidth operation of such antenna arrays.

Electromagnetic energy is radiated from and is received by specially designed antenna structures which can exist in many topological forms. Very common and simple antenna structures are seen in applications to automobile broadcast radio reception and domestic television reception. More complicated antenna structures can be seen in radar equipment used to detect distant moving targets for both military and civil purposes.

The most complex radar antennas are examples of a class of antenna arrays, employing a plurality of individual small antenna elements which are interconnected in ways designed to enable, for example, electronic steering of the radiated beams of electromagnetic energy in space, without physical movement of the whole array.

Individual antenna elements forming an array can be, for example, simple dipoles which are well known. Such elements are referred to as fundamental elements and usually have the smallest possible dimensions for a given frequency of the radiated energy (FIG. 1). The dipole arms 1*a* and 1*b* are usually each one quarter-wavelength long at the frequency of operation and are spaced one quarter wavelength x above a metallic ground plane 2 to give radiation in the desired direction z. Transmission line 3 supplies energy to the dipole arms 1*a* and 1*b*. The ratio of length 1 to diameter d is usually>10, which gives satisfactory performance over a narrow frequency band of a few percent with respect to the centre frequency of the band. The direction of the electric field vector is indicated by the arrow E.

Antenna Arrays can be made using a plurality of such elements, distributed uniformly or non-uniformly over a prescribed surface area, and chosen to provide the desired antenna radiation characteristics. The surface may be planar or curved in more than one plane and the perimeter may be of any shape, though it is commonly circular, or rectangular, or simply a straight line, which is the degenerate case for a rectangular aperture when one side of the rectangle has zero dimension.

FIG. 2 shows a rectangular array of M×N dipole elements 5 located over a metallic ground plane 6. Antenna elements in the array are spaced from each other by locating them on the nodal points of a geometrical lattice 4, which might be for example either rectangular (as shown) or triangular in nature. Spacing of the elements 5 from each other s, p, and d cannot exceed certain maximum fractions of the wavelength of the radiated electromagnetic energy if undesirable features in the array polar pattern are to be avoided. If this maximum element spacing is exceeded, in an attempt to minimise the number of elements in the array, then "grating lobes" are generated in the polar pattern of the radiated energy from the array. Grating lobes are replicas of the main (fundamental) lobe of the pattern but they are in different spatial directions from it.

In radar applications it is not possible to distinguish between targets detected in the main beam and in the grating lobe beams which results in ambiguities. A target detected in a grating lobe beam will be processed as if it had been received in the main beam and will be assigned a completely erroneous spatial direction by the radar signal processor. In radar and in other applications, such as broadcasting and communications services, grating lobes carry some of the energy to unwanted spatial regions and so reduce the operating efficiency of the system.

It is usually possible, for most narrow frequency bandwidth applications, to accept the array element spacing limitation. If the main beam of the radiated pattern is not to be electronically scanned the spacing d in FIG. 2 can be up to one half-wavelength at the operating frequency. If the beam is to be electronically scanned the spacing must be reduced as the maximum scan angle increases, down to a minimum of one half-wavelength for a scan of ninety degrees from the normal to the array surface.

However, there are occasions when it is necessary to transmit and receive electromagnetic energy over a wide frequency range, for example in frequency agile radars which operate at one or more frequencies distributed over a prescribed wide frequency range. Frequency agility can allow the radar or tactical communications system to continue to operate when interference, of whatever nature, overwhelms reception on any one frequency. Agility has other advantages in target detection and signal processing that are commonly exploited in radar equipment, particularly those applied to military functions.

It is usually desirable in such frequency agile military applications to operate over as wide a frequency band as possible; at least an octave. This requires that the individual elements of the array are capable of operating over the chosen frequency range and that their separations from each other meet the maximum spacing criterion already described, at all operating frequencies. Clearly this is not possible with conventional antenna elements such as single linear dipoles, even though there are established designs for wide-band dipoles which permit operation over a bandwidth of about 30% with respect to the mean frequency of the band. For example, a broad band half wave dipole is described in IEEE Transactions on Antennas and Propagation, Vol AP-32, No. 4, April 1984 pp 410–412 by M. C. Bailey and describes a bow-tie shaped dipole, which has a length equal to 0.32 of the mean wave-length of the band of operation, and has been shown to have acceptable performance over a 33% band-width, centred around 600 MHz, determined on the criterion that the input Voltage Standing Wave Ratio (VSWR) shall not exceed 2.0.

Even if it was possible to make a dipole capable of radiating over an octave change in frequency, it could not satisfy the separation condition necessary to ensure grating lobe free radiation over the octave range, from an array formed by a plurality of such dipoles. The length of the dipole would be between one half-wavelength at the lowest frequency and one half-wavelength at the highest frequency, and so the separation between dipoles in the array must exceed a half-wavelength at the highest frequency if physical interference between dipoles is to be avoided. Mathematical modelling of the bow-tie dipole described in the previously mentioned article in IEEE Transactions on Antennas and Propagation, using the proven analysis software Numerical Electromagnetic Code (NEC), has shown that it cannot be designed to operate over an octave frequency range.

The elements used in an array antenna need not be single dipoles. A Log-Periodic Dipole Array (LPDA) as shown in FIG. 3, in which a series of half-wavelength dipoles arranged in a coplanar and parallel configuration on a parallel wire transmission line 7, may be used as a very broadband element. The five element LPDA shown in FIG.

3 is representative of the LPDA class of antennas. The number of dipole elements used in the LPDA depends on the required performance characteristics. The lengths and spacing of the dipoles in the LPDA increase logarithmically in proportion to their distance from a fixed co-ordinate reference point 8. Energy is fed to the LPDA from the feed point 9 which is close to the dipole 10, in a direction towards the reference point 8.

The first and last dipoles 10 and 11 respectively are chosen to suit the frequency band of interest which can be several octaves or even a decade in extent. Dipole 10 will have dimensions chosen to make it radiate correctly at the high frequency end of the band. A metallic ground plane 12 is located approximately one quarter-wavelength at the lowest operating frequency from dipole 11 to provide unidirectional radiation which may be desirable in applications of the invention to radar for example, where energy radiated in the backward direction may have adverse effects on the operation of the radar. Transmission line 7 is short circuited by metallic ground-plane 12 where it intersects it at point A. Such LPDA's are well known, for example UK patent no. 884889 describes such an LPDA, and are in wide use. The direction of the electric field vector radiated or received by the LPDA, known as the polarisation of the wave, is shown by the arrow E. It lies in the common plane of the dipoles (horizontal as drawn) because the dipole excitation currents all lie in that plane.

A planar array antenna could comprise a plurality of LPDA elements arranged with the planes containing their individual sets of dipoles being normal to the planar array. FIG. 4 shows elements 14–18 in the array, located on the nodal points of rectangular lattice 19.

A planar array so formed has the advantage that the side-lobes of the pattern at wide angles from its normal direction are reduced, compared with the side-lobes from a corresponding array of single dipole elements, since the beamwidth of the LPDA element is narrower than that of the dipole element. However, the same element spacing criterion which applies to the array of the dipole elements to eliminate grating lobes applies to the array of LPDA elements, but the grating lobe magnitudes will be reduced by the narrow beam pattern of the LPDA element.

The LPDA overcomes the frequency bandwidth limitations of the single dipole element but, just as with the single wide bandwidth dipole, it fails to meet the spacing criterion necessary to suppress grating lobes generated by the planar array. For example, LPDA's 14 and 15 in FIG. 4 cannot be positioned closer in the array than the longest dipole element, 11 in FIG. 3, will allow. When this is done the high frequency elements, 20 in LPDA's 14 and 15 will be separated from each other by more than one half-wavelength at the high frequency; in fact by one wavelength if the LPDA is designed to operate over an octave, and grating lobes will be formed at the higher frequencies in the operating band.

SUMMARY OF THE INVENTION

An aim of the present invention is to provide a linear array element which overcomes the above-mentioned problems.

According to the present invention, there is provided a linear antenna array element comprising a plurality of skewed dipoles of unequal total length and at least one shorter non-skewed dipole. The dipoles have their respective poles skewed such that end sections there are of equal length and are formed substantially at an angle to a centre section of the dipole. The length of the centre section being substantially equal to the length of the shortest non-skewed dipole. The poles are connected alternately to respective two-conductor transmission lines to ensure correct excitation phases for operation, the conductors being parallel in the vertical plane and arranged such that the ratio of the length of each dipole to its distance from a fixed reference point located on an axis of said transmission line is constant. Each of the dipoles has a total length of substantially one half-wavelength "or multiples thereof" relating to the desired discrete transmit or receive frequency within the total band of frequencies.

The end sections are preferably skewed at right angles to the centre section.

According to a further aspect of the invention, each end section of a respective dipole is positioned in an opposite direction and lies in a vertical plane.

According to another aspect of the invention, each end section of a respective dipole points in an opposite direction and lies substantially in the same horizontal plane.

According to yet another aspect of the invention, each end section of a respective dipole points in the same direction and lies substantially in the same horizontal plane.

The present invention removes the restriction on spacing of the LPDA's in the planar array imposed by the lowest frequency (longest length) dipole in the LPDA, thus permitting acceptable operation of the planar array antenna over at least an octave frequency band.

It is evident that skewed LPDA elements may now be ideally positioned within an array, comprised of a plurality of such elements, with adjacent element separations which comply with the grating lobe suppression criterion, thus allowing the array antenna beam to be scanned in an ideal way over a frequency band of at least one octave.

A plurality of skewed LPDA elements may be used in arrays for particular system applications where wide bandwidth frequency agility can provide a useful counter to natural or manmade interfering signals received by the system.

BRIEF DESCRIPTION OF THE DRAWINGS

Various embodiments of the present invention will now be described with reference to the following drawings, wherein.

DETAILED DESCRIPTION OF THE DRAWINGS

Figure 1:
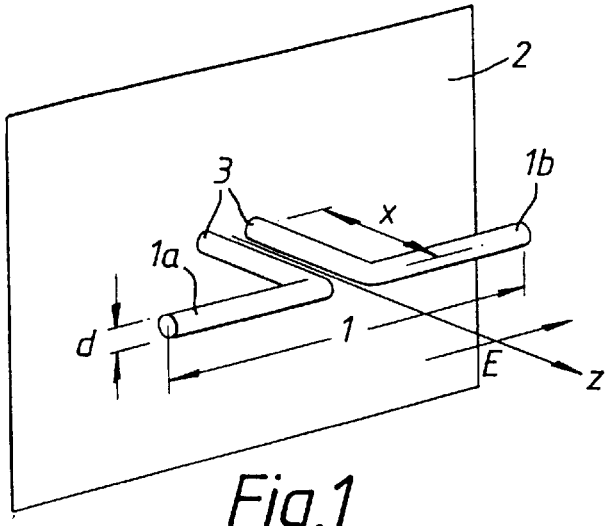
FIG. 1 is a schematic illustration of a fundamental element of a radio frequency antenna array.
Figure 2:
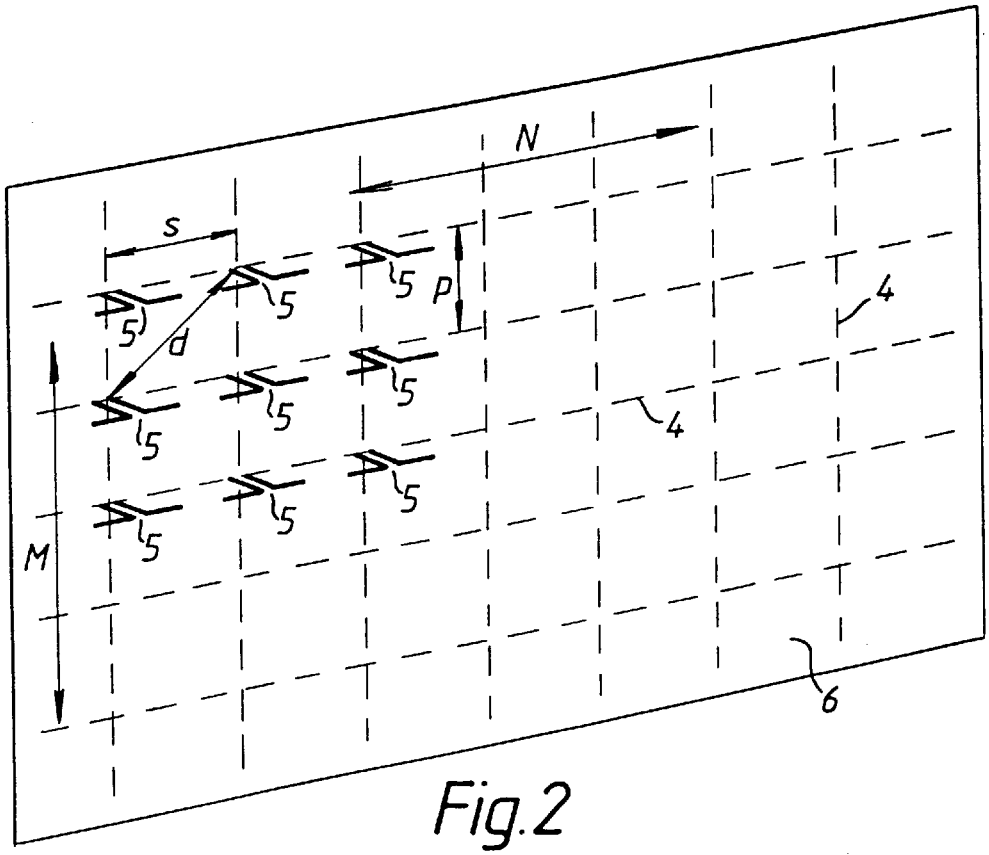
FIG. 2 is a schematic depiction of a rectangular array of M×N dipole elements located over a metallic ground plane.
Figure 3:
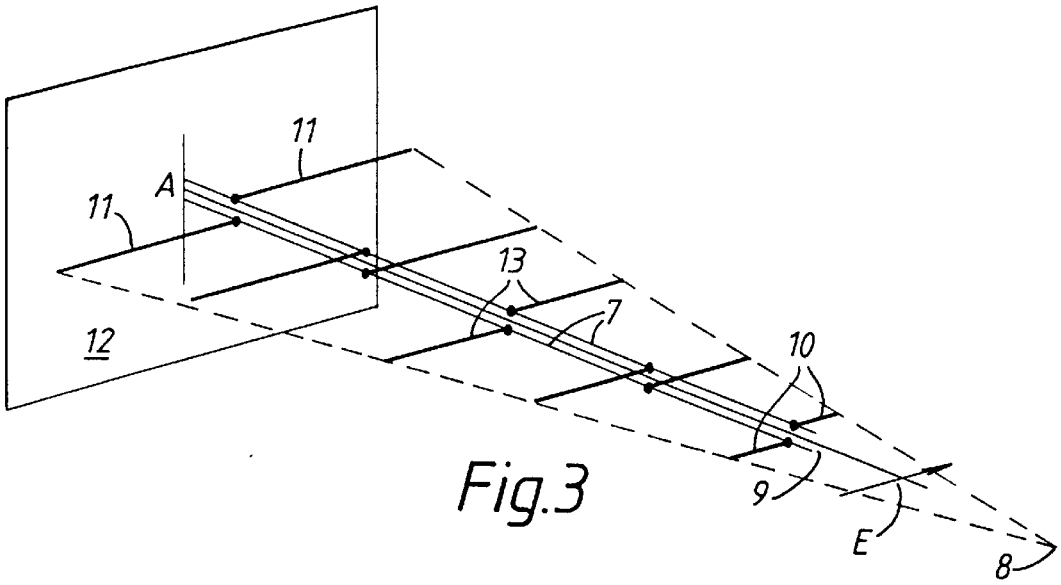
FIG. 3 is a schematic depiction of a Log-Periodic Dipole Array.
Figure 4:
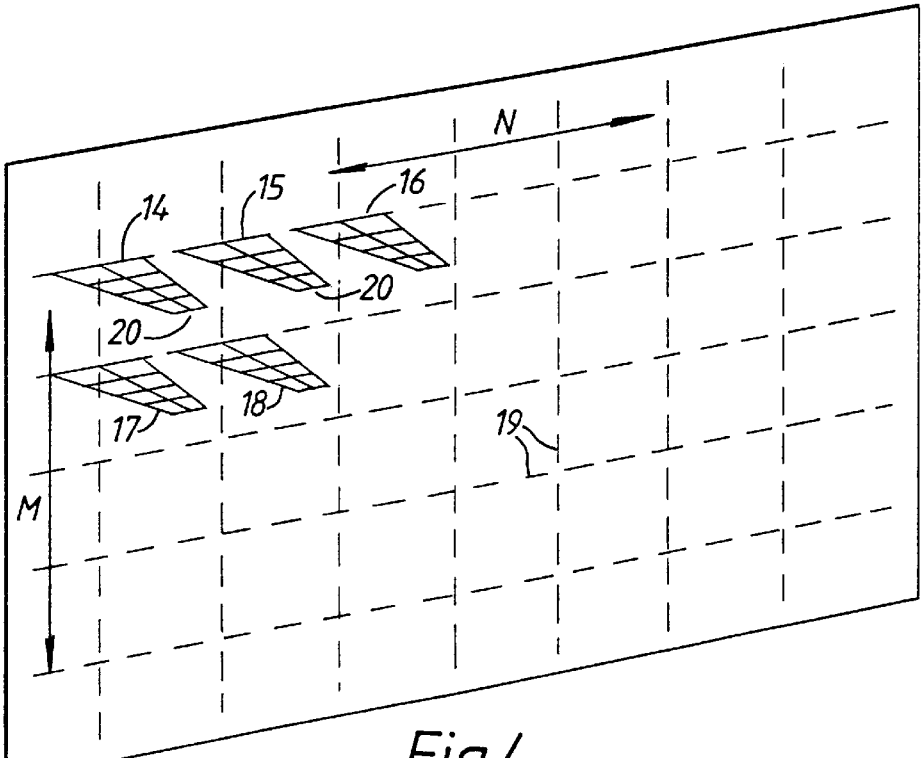
FIG. 4 is a schematic depiction of a plurality of elements according to FIG. 3 located on the nodal points of a rectangular lattice.
Figure 5:
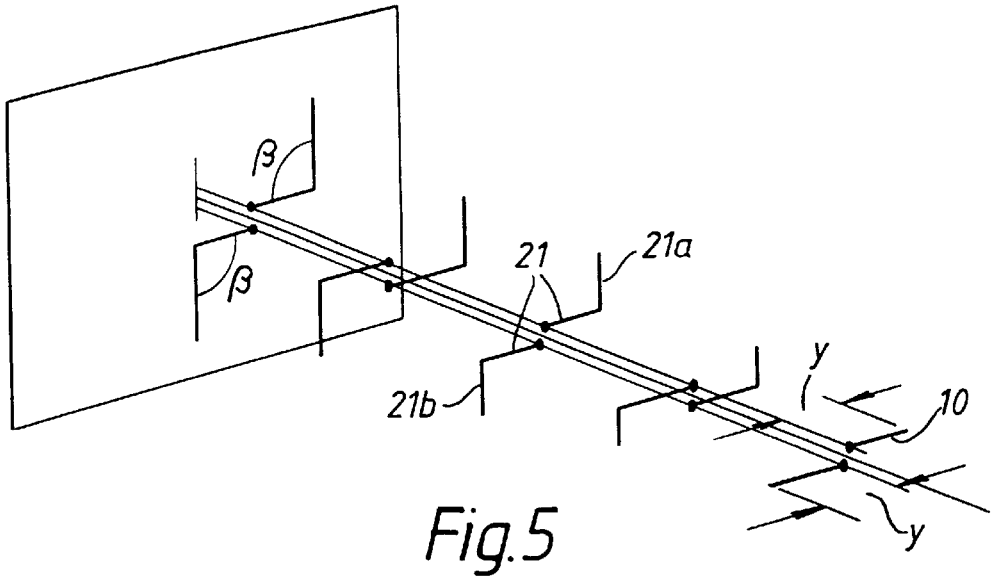
FIG. 5 shows a skewed Log-Periodic Dipole Array (LPDA), in accordance with the present invention.

Referring to FIG. 5, there is shown a skewed LPDA in which the individual dipoles are arranged to be "Z" shaped or skewed, the angles β between the end segments and the centre segment being equal to each other, such that the skewed dipole can be totally contained within a planar area, where in the case illustrated the angles β are 90 degrees. More specifically the centre segments of all of the dipoles are made equal in length and equal to one half-wavelength at the highest frequency of operation, that is equal in length (2 times y) to the shortest dipole 10 in a conventional non-skewed LPDA. The two end segments 21*a* and 21*b* of the 90 degree skewed dipole 21, for example have equal lengths such that the total dipole length is the same as its equivalent straight dipole shown as 13 in FIG. 3. Thus the "width" of the LPDA is constant and is controlled by the highest frequency of operation irrespective of the bandwidth requirement.

An LPDA formed by a plurality of such skewed dipoles can be constructed in several ways. FIGS. 6 to 9 show four embodiments of the invention. It will assist the understanding of the description to visualise the metallic ground plane as a vertically oriented plane and the two-wire transmission line existing in a second vertical plane meeting the ground plane at right angles.

Figure 6:
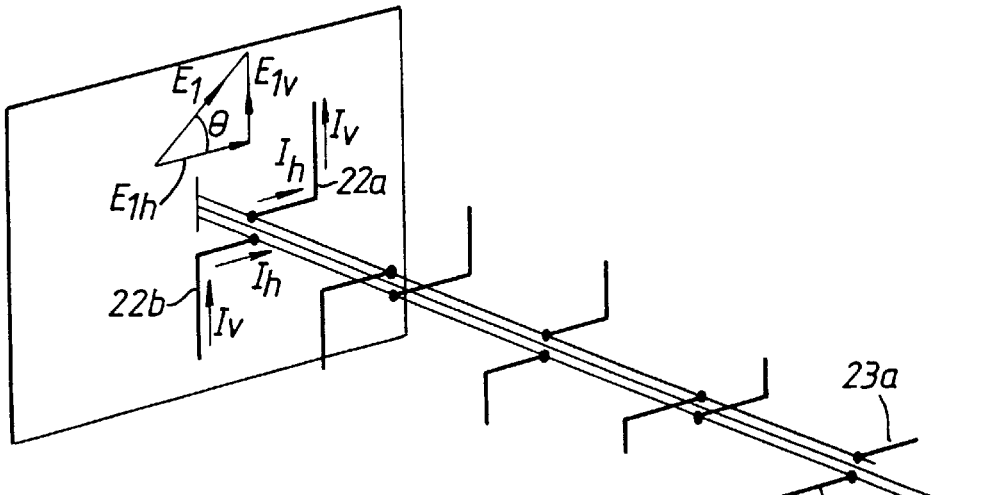
FIGS. 6, 7, 8 and 9 show alternative embodiments of an LPDA in accordance with the present invention.

In FIG. 6 the planes containing each of the dipoles that form the LPDA are parallel to each other and parallel to the metallic ground plane. However, the radiated electric field vector E is now no longer in the horizontal plane since the dipoles forming the skewed LPDA have current carrying components ($I_h$) and ($I_v$) in the horizontal and vertical planes respectively. The polarisation of a signal transmitted by the LPDA is still linear but it is in an inclined plane, and is the vector addition of the horizontal and vertical components of the electric field radiated by the component parts of the skewed dipoles. It is shown in FIG. 6 for the low frequency dipole arms 22*a* and 22*b* as the components $E_{lh}$ and $E_{lv}$ and by vector addition the net low frequency field $E_l=E_{lh}+E_{lv}$ and it is inclined at angle θ to the horizontal where θ is given by $\tan^{-1}(E_{lv}/E_{lh})$. Clearly θ is a maximum for the low frequency dipole. It is zero for the high frequency dipole since it carries no vertical current components. Thus the polarisation of the electric field radiated by the skewed LPDA is linear and its direction is a function of frequency. By reciprocity the same statement holds for signals received by the antenna.

In radar the polarisation of the transmitted signal and hence the polarisation of the received signal is chosen principally through consideration of the nature of the expected targets and terrain clutter. It is usually horizontal, vertical, or at 45 degrees. Depending on the nature of the radar and its application, the ability to operate over a very wide agile bandwidth may override any disadvantages that may result from polarisation rotation with frequency. At very high frequencies (VHF) and ultra high frequencies (UHF), there are clear benefits from the diffraction occurring at the lower frequencies (VHF), when the polarisation is vertical and foliage penetration properties of the higher frequencies (UHF), when the polarisation is horizontal. These advantages could be realised from a planar array of a plurality of the skewed LPDA element illustrated in FIG. 6 if the skewed LPDA is designed to cover the appropriate parts of the VHF and UHF bands.

Figure 7:
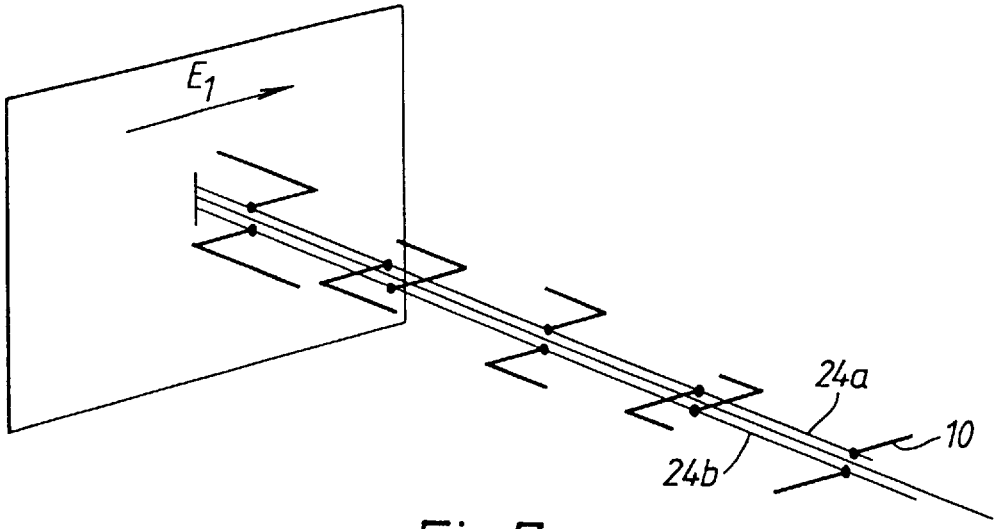

A second embodiment of the invention is shown in FIG. 7. Here the skewed dipoles are constrained to a single horizontal plane, ignoring the small separation of the conductors forming the feed transmission line 24*a* and 24*b*. The linear polarisation of the electric field transmitted by this embodiment of the skewed LPDA is therefore horizontal, as might be a specified requirement for a particular application of the invention, for example higher frequency radar where the diffraction and foliage penetration mechanisms are virtually insignificant.

Figure 8:
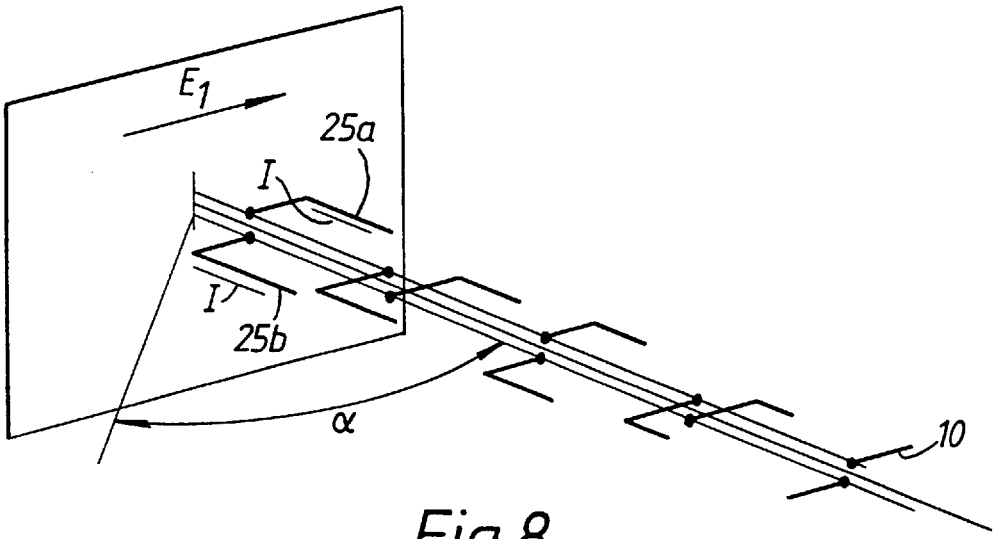

It has been found that when the end segments of the dipoles are skewed such that they are "C" shaped and they are arranged in a parallel and coplanar manner, as shown in FIG. 8, the skewed LPDA so formed has improved performance at wide angles (α), when compared with the performance of the embodiment shown in FIG. 7. This is because the currents carried by the end segments of the "C" dipole are equal in magnitude and opposite in direction, hence the field components radiated by them tend to cancel. When α=90 degrees the components exactly cancel and no radiation occurs in that direction, which is ideal for a skewed LPDA element used in a planar array for radar applications, for example.

Figure 9:
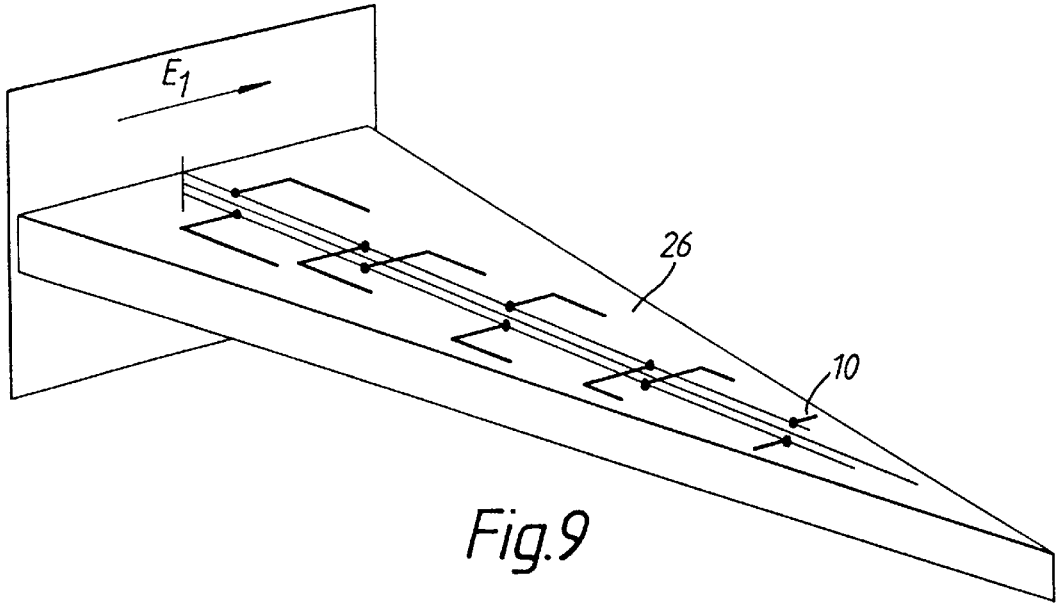

A fourth embodiment of the invention is illustrated in FIG. 9 where skewed dipoles of the form illustrated in FIG. 8 and the transmission line feeding them is etched onto a double sided or two single sided printed circuit boards 26 as a totally integrated assembly. This method of construction permits superior control of manufacturing tolerances and good repeatability which is an important advantage at frequencies where the wavelengths are very small. The dipole elements and transmission lines may be contained within a sheet of dielectric material which tapers from a dimension encompassing the largest skewed dipole to a zero dimension at a point beyond the shortest and non-skewed dipole.

In each of the embodiments described above, there may be provided a number of non-skewed dipoles 10 at the end of the array.

Figure 10:
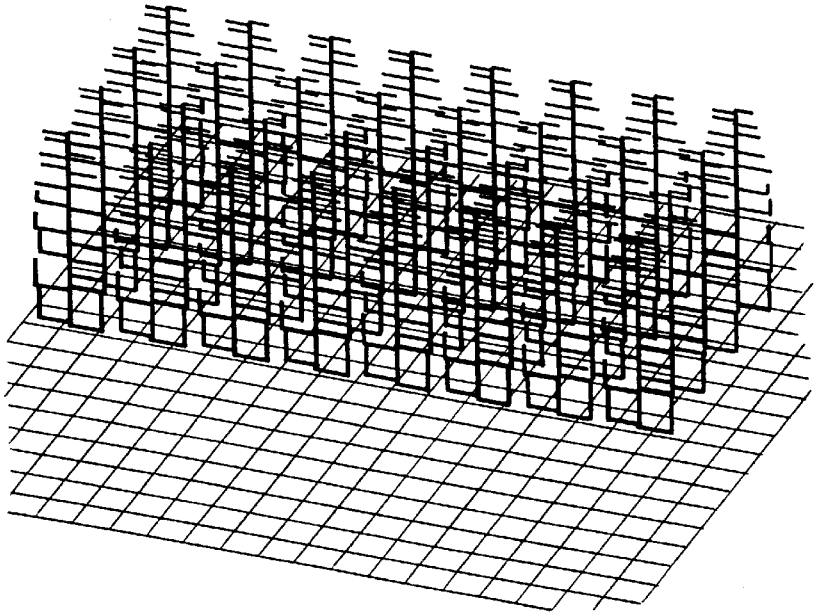
FIG. 10 shows a planar array of skewed LPDA's.

An embodiment of the invention in a planar array of identical skewed LPDA elements is illustrated in FIG. 10. The elements are positioned on a regular rectangular lattice, having their respective axes parallel to each other and at right angles to a line forming a basis of said linear array.

A planar array may be constructed of any shape consisting of a plurality of linear array elements as previously described. The linear array elements may be located with regular or irregular separations on nodal points of a lattice. The nodal points may be rectangular, triangular or any other geometrical shape such that the axes of the linear array elements are parallel to each other and are at right angles to the plane of the planar array.

A non planar array may be formed by either singly or doubly curving the surface of the above described planar array.

The application of the invention is not limited to the VHF and UHF bands and can in principle be used to significant advantage in any planar or linear array antenna required to operate over wide bandwidths, particularly an octave or more, for radar, communications, or other purposes. The upper frequency limit is driven by the accuracy to which the feed point and transmission line can be constructed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

I claim:

1. A linear antenna array element comprising a plurality of skewed dipoles of unequal total length and at least one shorter non-skewed dipole, said skewed dipoles having their respective poles skewed such that end sections of said dipoles are of equal length and formed at an angle to a center section of said dipole, where a length of said center section is substantially equal to a length of the shortest non-skewed dipole, said poles being connected alternately to respective two-conductor transmission lines to ensure correct excitation phases for operation, the conductors being parallel in the vertical plane and arranged such that the ratio of the length of each dipole to its distance from a fixed reference point located on an axis of said transmission line is constant, and each of said dipoles having a total length substantially equal to one half-wavelength, or multiples thereof, of a desired discrete transmit or receive frequency within the total band of frequencies.

2. A linear antenna array as claimed in claim 1, wherein the end sections are skewed substantially at right angles to the center sections.

3. A linear antenna array element as claimed in claim 2 wherein each end section of a respective dipole is positioned in an opposite direction and lies in a vertical plane.

4. A linear antenna array element as claimed in claim 2 wherein each end section of a respective dipole points in an opposite direction and lies substantially in a horizontal plane.

5. A linear antenna array element as claimed in claim 2 wherein each end section of a respective dipole points in the same direction and lies substantially in the same horizontal plane.

6. A linear antenna array element as claimed in claim 1 wherein each end section of a respective dipole is positioned in an opposite direction and lies in a vertical plane.

7. A linear antenna array element as claimed in claim 1 wherein each end section of a respective dipole points in an opposite direction and lies substantially in a horizontal plane.

8. A linear antenna array element as claimed in claim 7 wherein the dipoles and their respective conductor of the transmission line are etched onto a printed circuit board, the planar surfaces of which are substantially parallel.

9. A linear array element as claimed in claim 8 wherein the dipoles and the transmission line are contained within a sheet of dielectric material which tapers from a dimension encompassing the largest skewed dipole to a zero dimension at a point beyond the shortest and non-skewed dipole.

10. A linear array element as claimed in claim 7 wherein each conductor of the transmission line and the respective poles connected thereto, are etched onto separate sides of the printed circuit board.

11. A linear antenna array element as claimed in claim 1 wherein each end section of a respective dipole points in the same direction and lies substantially in the same horizontal plane.

12. A linear antenna array element as claimed in claim 11 wherein the dipoles and their respective conductor of the transmission line are etched onto a printed circuit board, the planar surfaces of which are substantially parallel.

13. A linear array element as claimed in claim 11 wherein each conductor of the transmission line and the respective poles connected thereto, are etched onto separate sides of the printed circuit board.

14. A linear array element as claimed in claim 11 wherein the dipoles and the transmission line are contained within a sheet of dielectric material which tapers from a dimension encompassing the largest skewed dipole to a zero dimension at a point beyond the shortest and non-skewed dipole.

15. A linear array formed by a plurality of linear antenna array elements according to claim 1 wherein axes of said antenna array elements are parallel to each other and are at right angles to a line forming a basis of said linear array.

16. A planar array comprising a plurality of linear antenna array elements according to 1 wherein said linear antenna array elements are located on nodal points of a lattice, with axes of said linear antenna array elements parallel to each other and at right angles to the plane of said planar array.

17. Planar array according to claim 16 wherein said linear antenna array elements are spaced at regular separations.

18. Planar array according to claim 16 wherein said lattic is one of rectangular and triangular.

19. A non-planar area array formed by curving a surface of said planar array as claimed in claim 16.

20. Non-planar array according to claim 19 wherein said surface is doubly curved.

* * * * *